US009883729B2

(12) United States Patent
Lorbecki

(10) Patent No.: US 9,883,729 B2
(45) Date of Patent: Feb. 6, 2018

(54) HYDRA RING

(71) Applicant: Todd Anthony Lorbecki, Wauwatosa, WI (US)

(72) Inventor: Todd Anthony Lorbecki, Wauwatosa, WI (US)

( * ) Notice: Subject to any disclaimer, the term of this patent is extended or adjusted under 35 U.S.C. 154(b) by 60 days.

(21) Appl. No.: 14/998,779

(22) Filed: Feb. 16, 2016

(65) Prior Publication Data

US 2016/0262525 A1 Sep. 15, 2016

Related U.S. Application Data

(60) Provisional application No. 62/177,294, filed on Mar. 12, 2015.

(51) Int. Cl.
*A45F 3/04* (2006.01)
*A45F 3/16* (2006.01)

(52) U.S. Cl.
CPC ..... *A45F 3/16* (2013.01); *A45F 3/04* (2013.01); *A45F 2003/166* (2013.01)

(58) Field of Classification Search
CPC ..... A45F 3/16; A45F 2003/166; A45F 3/04; B67D 2210/00131
USPC ..... 224/148.1, 148.2, 148.3, 148.7
See application file for complete search history.

(56) References Cited

U.S. PATENT DOCUMENTS 4,948,023 A * 8/1990 Tripp ..... A45F 3/16 222/175
7,552,734 B2 * 6/2009 Adams ..... A01K 7/00 128/847
2007/0090135 A1 * 4/2007 Benham ..... A45F 3/20 224/148.2

* cited by examiner

*Primary Examiner* — Adam Waggenspack
(74) *Attorney, Agent, or Firm* — Ziolkowski Patent Solutions Group, SC

(57) ABSTRACT

A lightweight hydration backpack is disclosed that can go under or over clothing and is hands free with tubes that work in the same way canvas straps work on a backpack making it easy to slip on or off. The tubes, which also double as left and right shoulder straps, deliver the liquid to the user along with supporting the weight of the liquid in the collapsible bottles on the back of the pack. The tubes can be easily released from the connectors by hand, allowing for easy cleaning and also allowing the user to cut the released tubes to fit his or her own torso size.

10 Claims, 5 Drawing Sheets

HYDRA RING

CROSS REFERENCE TO RELATED APPLICATION

The present invention is a non-provisional of and claims priority to U.S. Provisional Patent Application Ser. No. 62/177,294 filed Mar. 12, 2015, the disclosure of which is incorporated herein by reference in its entirety.

FIELD OF THE INVENTION

Embodiments of the invention are directed generally to a hydration unit and, more particularly, to a hands-free wearable hydration unit that solves the problem of having to inconveniently stop to get a water bottle, glass, or cup while engaging in light or heavy activities; making it easy to drink during continuing movement.

BRIEF DESCRIPTION OF THE SEVERAL VIEWS OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE INVENTION

FIGS. 1-5 illustrate various views of a collapsible, easily cleaned, discreet, and convenient hands-free wearable hydration unit 1 for people on the go. Following here below is a general listing of the components from which the hydration pack 1 is composed, as well as a description of the interfitting of such components and the interaction therebetween.

Figure 1:
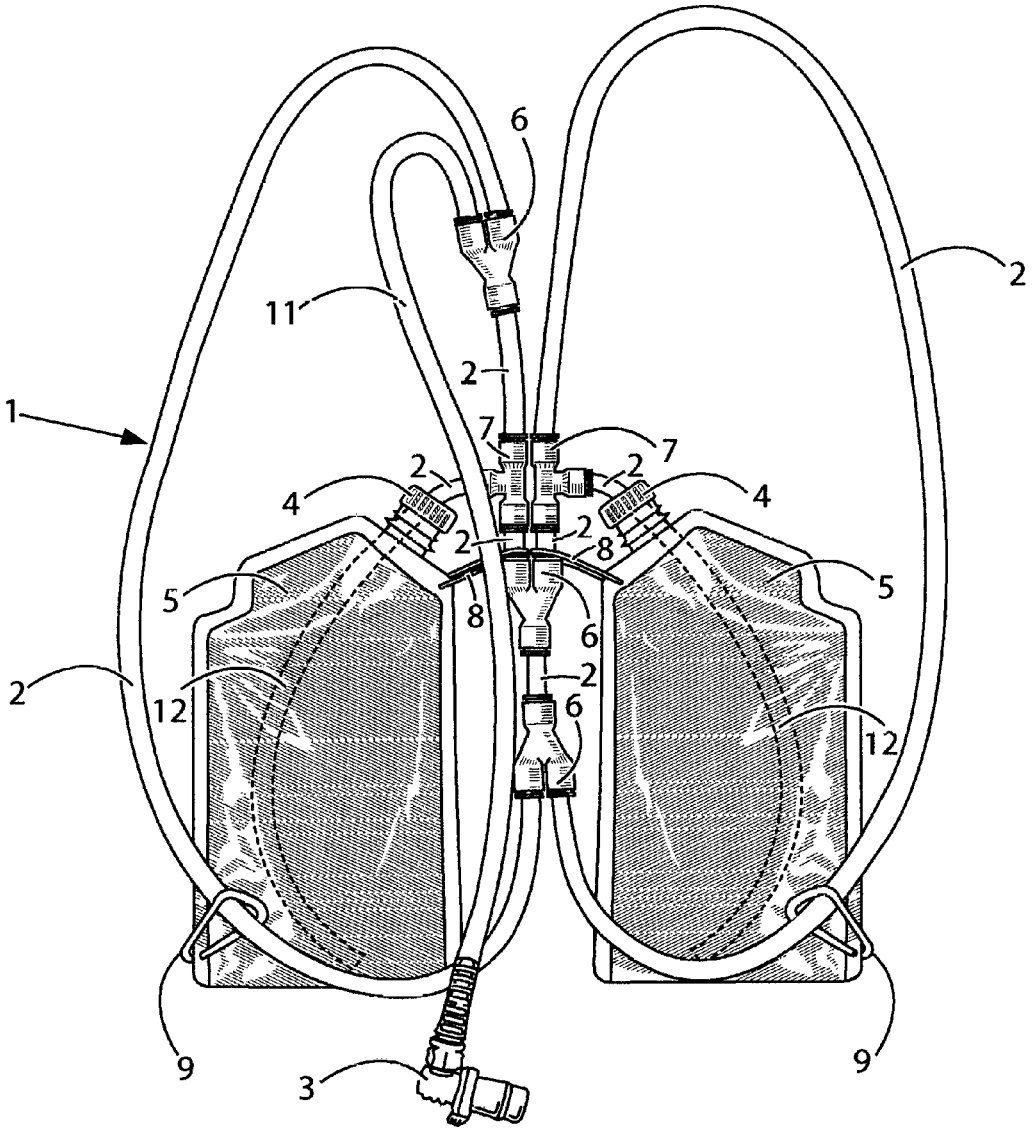
FIG. 1 is a front view of an embodiment of a hydration pack in accordance with the present invention.

Referring to FIG. 1, a front view of a tube strapped wearable hydration pack 1 in a configuration of a traditional backpack shape is illustrated. In FIG. 1, the components of the hydration pack 1 that are highlighted/described include:

a plurality of tubes or hoses 2 that, according to an exemplary embodiment, are Tygon® Silver ¼" inner diameter, ⅜" outer diameter BPA free drink tubes;

an L shaped bite valve 3;

28 mm diameter water tight plastic screw-on caps 4 with a 11/32" hole drilled in the top center of it for entry of a drink tube 12 therethrough (e.g., Tygon® Silver ⅜" outer diameter drink tube);

a 25 ounce BPA free collapsible water bottles 5;

Parker LIQUIfit™ Union Y BPA free quick release push-to-connect fittings 6;

Parker LIQUIfit Union Tee BPA free quick release push-to-connect fittings 7;

8 inch long plastic cable ties 8;

1.75" long carabineer clips 9;

a user drink tube 11 (e.g., Tygon® Silver ¼" inner diameter and ⅜" outer diameter BPA free drink tube) headed to the mouth of the user; and drink tubes 12 (e.g., Tygon® Silver ¼" inner diameter and ⅜" outer diameter BPA free drink tubes) inserted into the 25 ounce BPA free collapsible water bottles 5.

Figure 2:
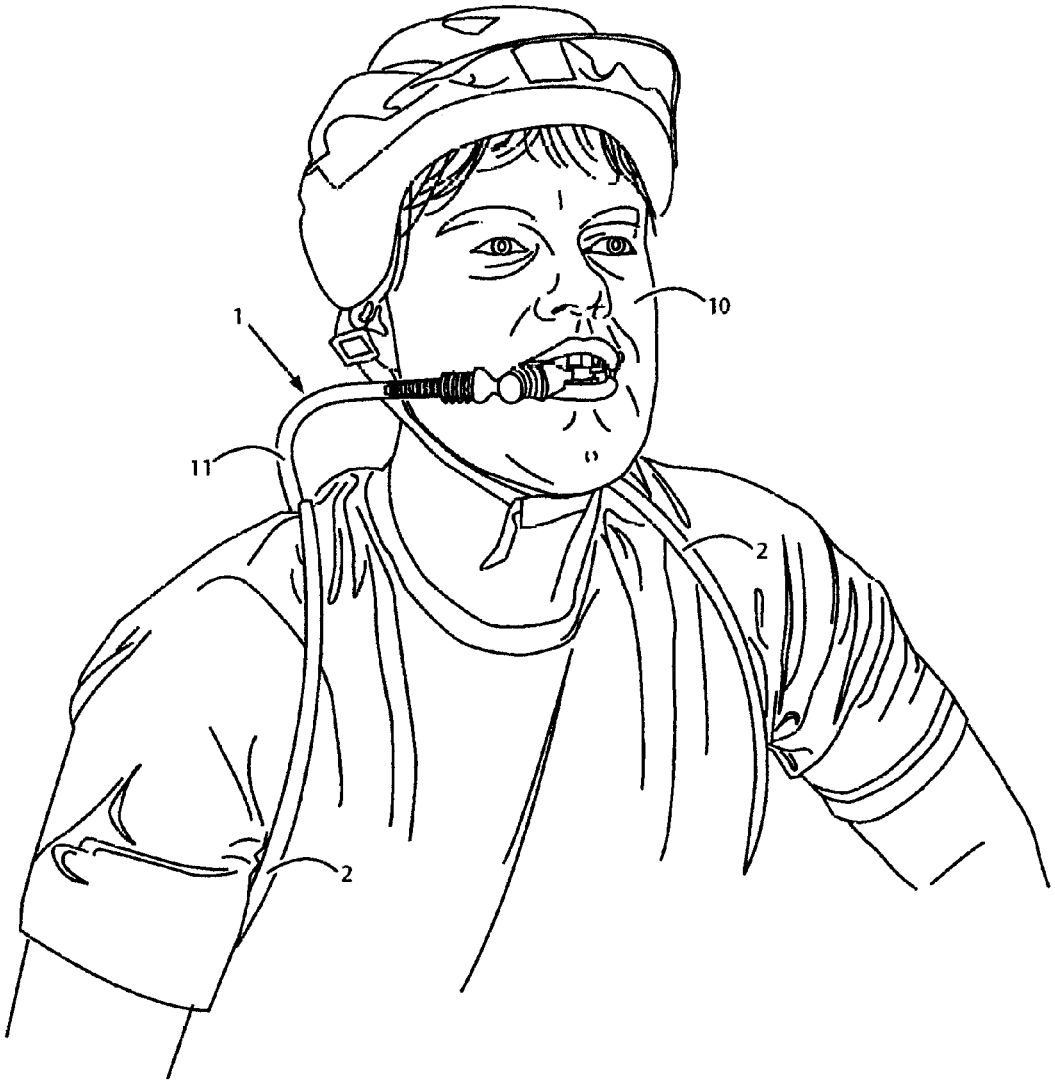
FIG. 2 is a three-quarter front perspective view of the hydration pack shown in FIG. 1 displayed on a person.

FIG. 2. Illustrates a three-quarter view of a man 10 while wearing the tube strapped wearable hydration pack 1 in configuration of a traditional backpack shape. In FIG. 2, the components of the hydration pack 1 that are highlighted/described include:

the plurality of tubes or hoses 2 that, according to an exemplary embodiment, are Tygon® Silver ¼" inner diameter and ⅜" outer diameter BPA free drink tubes; and The user drink tube 11 (e.g., Tygon Silver ¼" inner diameter and ⅜" outer diameter BPA free drink tube) headed to the mouth of the user 10.

Figure 3:
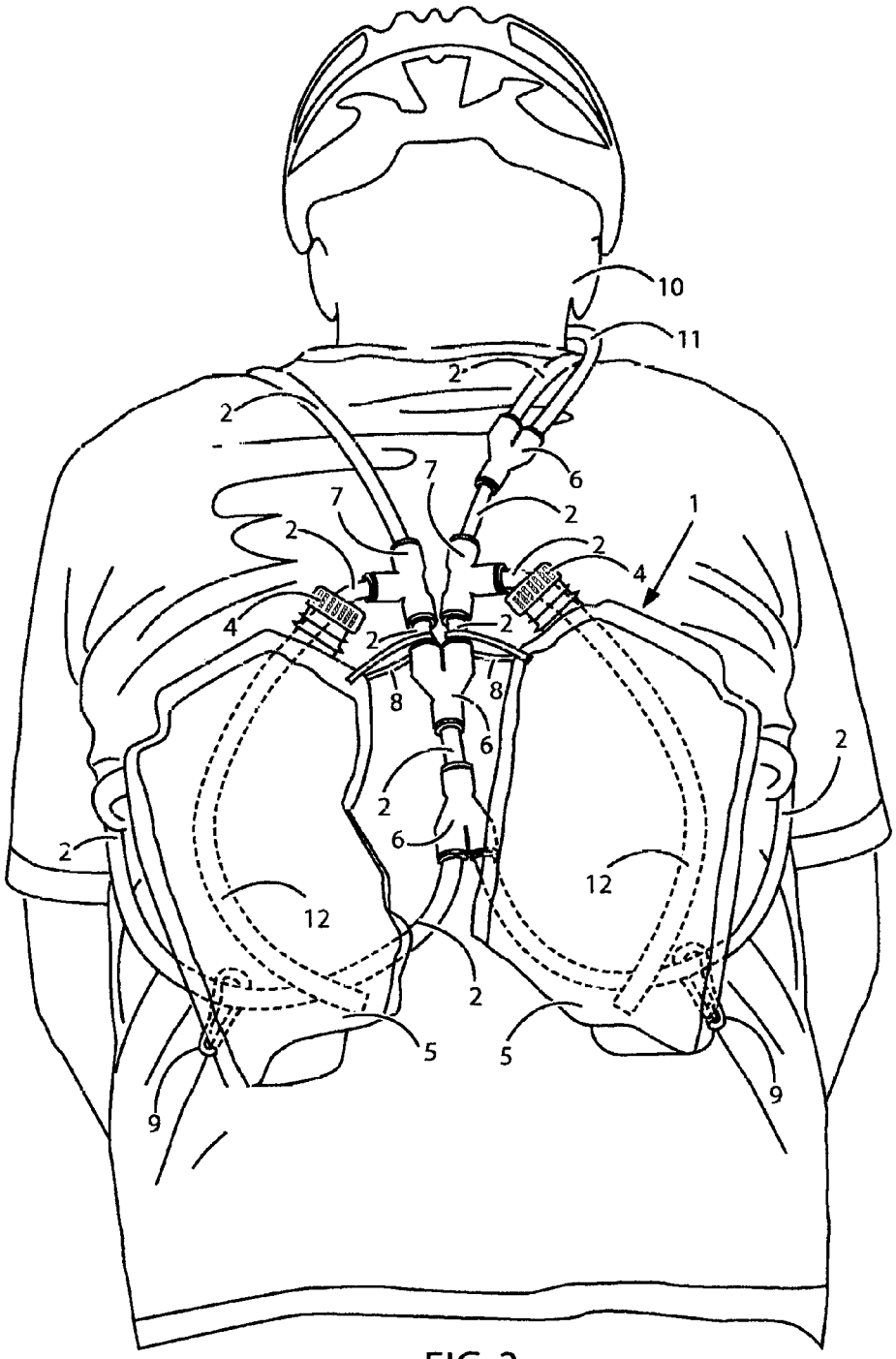
FIG. 3 is a rear perspective view of the hydration pack shown in FIG. 1 displayed on a person.

FIG. 3. illustrates a back view of the man 10 cycling while wearing the tube strapped wearable hydration pack 1 in configuration of a traditional backpack shape. In FIG. 3, the components of the hydration pack 1 that are highlighted/described include:

the plurality of tubes or hoses 2 that, according to an exemplary embodiment, are Tygon® Silver ¼" inner diameter and ⅜" outer diameter BPA free drink tubes;

the 28 mm diameter water tight plastic screw-on caps 4 with a 11/32" hole drilled in the top center of it for entry of the drink tube 12 therethrough (e.g., Tygon® Silver ⅜" outer diameter drink tube);

the 25 ounce BPA free collapsible water bottles 5, with it being recognized that different sized collapsible water bottles could be used instead of the 25 ounce size bottles 5;

the Parker LIQUIfit™ Union Y BPA free quick release push-to-connect fittings 6;

the Parker LIQUIfit™ Union Tee BPA free quick release push-to-connect fittings 7;

the 8 inch long plastic cable ties 8;

the 1.75" long carabineer clips 9;

the user drink tube 11 (e.g., Tygon® Silver ¼" inner diameter and ⅜" outer diameter BPA free drink tube) headed to the mouth of the user 10;

the drink tubes 12 (e.g., Tygon® Silver ¼" inner diameter and ⅜" outer diameter BPA free drink tubes) inserted into the 25 ounce BPA free collapsible water bottles 5.

Figure 4:
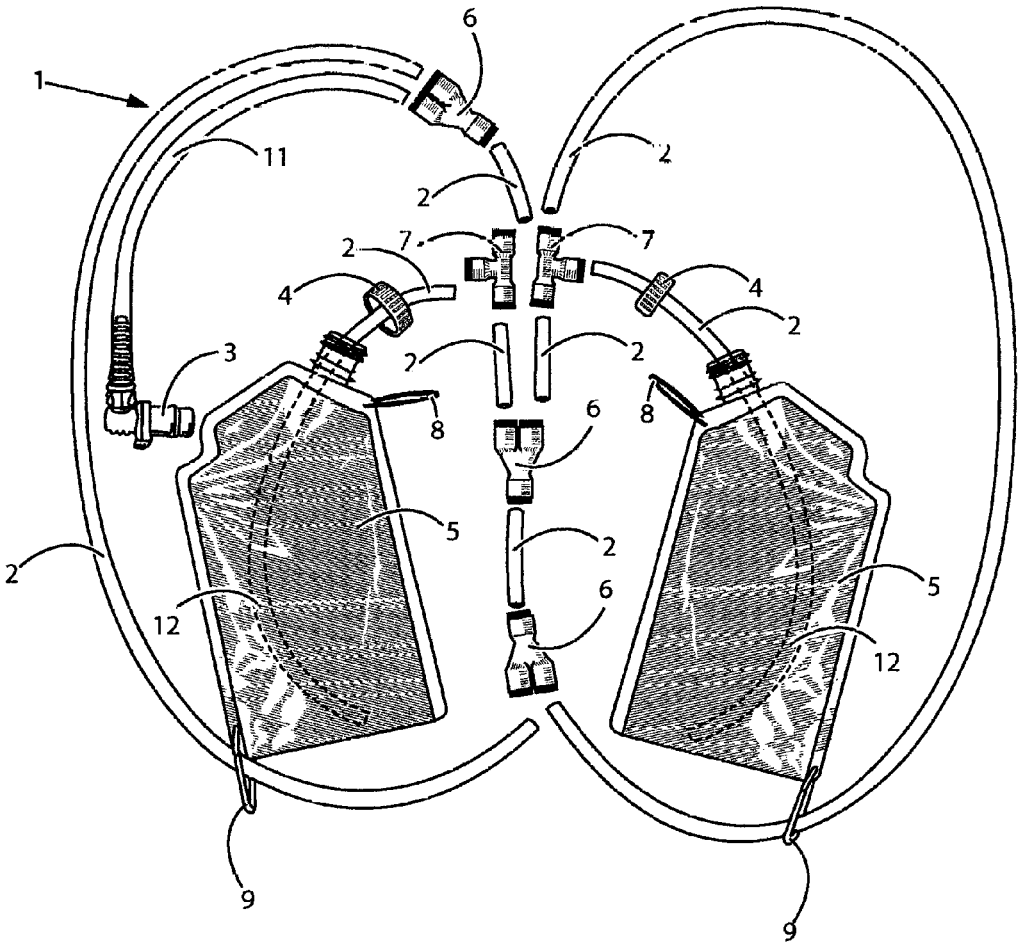
FIG. 4 is a exploded view of the hydration pack shown in FIG. 1 with the Parker LIQUIfit Union BPA free push-to-connect fittings disconnected from the drink hoses.
Figure 5:
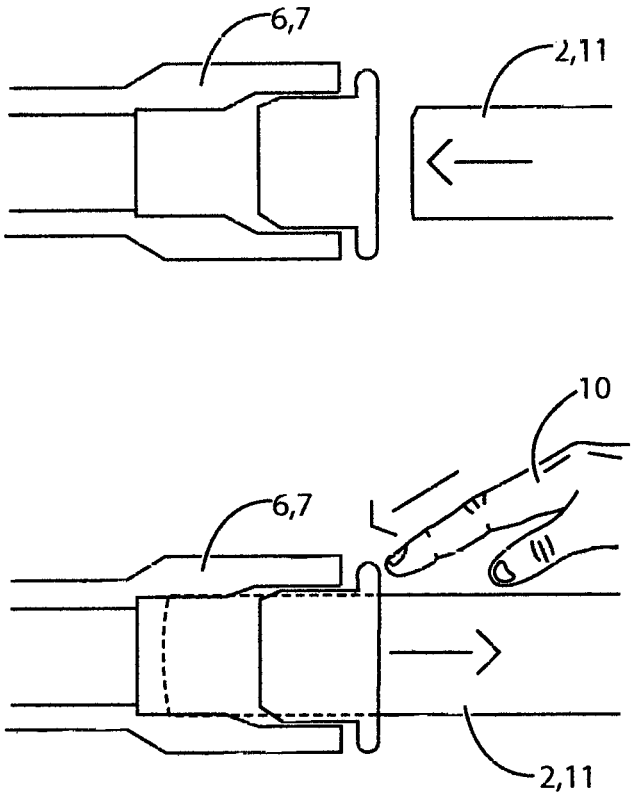
FIG. 5 is a cross section view of how the Legris quick release fittings work on the hydration pack shown in FIG. 1.

FIG. 4. illustrates an exploded view of the tube strapped wearable hydration pack 1 in a configuration of a traditional backpack shape shown in FIGS. 1, 2, and 3 [[4]] with the Parker LIQUIfit™ Union BPA free push-to-connect fittings 6, 7 disconnected from the Tygon Silver ⅜" outer diameter drink tubes 2, 11, 12. Once the drink tubes 2, 11, 12 are released from the push-to-connect fittings 6, 7, they enable the user to easily clean the drink tubes 2, 11, 12 along with also allowing the user to cut the released drink tubes 2, 11, 12 to fit his or her own torso size. In FIG. 4, the components of the hydration pack 1 that are highlighted/described include:

the plurality of tubes or hoses 2 that, according to an exemplary embodiment, are Tygon® Silver ¼" inner diameter and ⅜" outer diameter BPA free drink tubes;

the L shaped bite valve 3;

the 28 mm diameter water tight plastic screw-on caps 4 with a 11/32" hole drilled in the top center of it for entry of the drink tube 12 therethrough (e.g., a Tygon Silver ⅜" outer diameter drink tube 12);

the 25 ounce BPA free plastic collapsible water bottles 5;

the Parker LIQUIfit™ Union Y BPA free quick release push-to-connect fittings 6;

the Parker LIQUIfit™ Union Tee BPA free quick release push-to-connect fittings 7;

the 8 inch long plastic cable ties 8;

the 1.75" long carabineer clips 9;

the user drink tube 11 (e.g., Tygon® Silver ¼" inner diameter and ⅜" outer diameter BPA free drink tube) headed to the mouth of the user 10; And the drink tubes 12 (e.g., Tygon® Silver ¼" inner diameter and ⅜" outer diameter BPA free drink tubes) inserted into the 25 ounce BPA free collapsible water bottles 5;

FIG. 5 is a cross section view including a man's hand demonstrating how the Legris quick release push-to-connect fittings 6, 7 work on the hydration pack shown in FIG. 1. In FIG. 5, the components of the hydration pack 1 that are highlighted/described include:

the Parker LIQUIfit™ Union Y BPA free quick release push-to-connect fittings 6;

the Parker LIQUIfit™ Union Tee BPA free quick release push-to-connect fittings 7;

the plurality of tubes or hoses 2 that, according to an exemplary embodiment, are Tygon® Silver ¼" inner diameter and ⅜" outer diameter BPA free drink tubes.

the user drink tube 11 (e.g., Tygon® Silver ¼" inner diameter and ⅜" outer diameter BPA free drink tube) headed to the mouth of the user 10; and the drink tubes 12 (e.g., Tygon® Silver ¼" inner diameter and ⅜" outer diameter BPA free drink tubes) inserted into the 25 ounce BPA free collapsible water bottles 5.

Collectively, the tubes 2, 11, 12, collapsible water bottles 5, carabineer clips 9, zip ties 8, quick release fittings 6, 7, and bite valve 11 come together to form the shape and purpose of a lightweight hydration backpack 1 that can go under or over clothing and is hands-free, with tubes 2, 11, 12 that work in the same way canvas straps work on a traditional backpack, making the hydration pack/unit 1 easy to slip on or off. The tubes 2, 11, 12, which also double as left and right shoulder straps, deliver the liquid to the user 10 along with supporting the weight of the liquid in the collapsible bottles 5 on the back of the pack 1. In the hydration pack 1, all the tubes 2, 11, 12 can be easily released from the connectors 6, 7 by hand, allowing for easy cleaning of the tubes 2, 11, 12 and also allowing the user to cut the released tubes to fit his or her own torso size. The hydration pack 1 has two collapsible water bottles 5 instead of one to minimize the sloshing effect that one large water reservoir tends to have, which is commonly used by many other hydration backpacks on the market today. Having two collapsible bottles 5 instead of one also has an added benefit of allowing the user 10 to draw up two separate types of fluids (one in each bottle) and have them merge within the tubes 2, 11, 12 as a freshly mixed beverage before it reaches the users mouth.

Beneficially, the hydration unit 1 differs from other prior art units because the hoses/tubes 2, 11, 12 not only deliver the fluid to the person wearing it, but it also acts as the straps of the pack/unit 1 bearing the weight of the two collapsible water flasks 5. Because the hoses 2, 11, 12 support the weight, it allows for the elimination of the usual canvas straps and bulky pack that comes with must hydration units, thus also eliminating the sweat that said canvas straps and pack tend to absorb during strenuous activity. This is a minimalist hydration unit that allows the user a light weight discreet alternative. The user can wear the unit hidden under or over a shirt and stay hydrated while never having to stop to get a drink or disrupt their form, such as by bending to get a water bottle while cycling or running. Additionally, with the hydration unit 1, the user is not forced to wear a hot, sweat-soaked, overbearing backpack or water helmet, or forced to stumble while inserting their water bottle back into its cage while cycling. When done, the user can stow the empty folded hydration unit 1 in an on-bike storage pack, suitcase, gym bag, cinch sack, glove compartment or other storage device. The hydration unit 1 also utilizes two collapsible water bottles 5 instead of one in order to help stabilize the sloshing effect water has during fast movement that accompanies most sports and recreational activities. The collapsible water bottles 5 also have large ¾" diameter bottle openings for easy filling. All hoses 2, 11, 12 can be easily released using, for example, the Legris quick release fittings 6, 7 allowing the user to easily clean all the hoses 2, 11, 12 with a brush. The hydration unit 1 comes with a bite valve 11 for convenient delivery of fluid to the mouth. According to an exemplary embodiment, the tubes 2, 11, 12 on the hydration unit 1 also are Tygon® Silver tubes to prevent the spread of bacteria.

The invention claimed is:

1. A hydration pack for a user comprising:

one or more collapsible water flasks configured to carry fluid therein; and a plurality of tubes comprising:

a pair of tubes comprising a first drinking tube and a second drinking tube that are fluidly connected to the one or more collapsible water flasks to form a pair of shoulder straps on the hydration pack; and a plurality of additional tubes fluidly connected to the one or more collapsible water flasks to transport fluid out therefrom and provide fluid to the user; and wherein the pair of tubes support the weight of the one or more collapsible water flasks, along with any fluid therein a plurality of quick release connectors each configured to secure one or more of the plurality of tubes therein and provide for selective engagement and release of the plurality of tubes, the first and second drinking tubes each comprising a loop formed by connection of the first tube and the second tube to respective quick release connectors, with the loops forming the shoulder straps of the hydration pack.

2. The hydration pack of claim 1 wherein the one or more collapsible water flasks comprises two collapsible water flasks.

3. The hydration pack of claim 1 wherein the plurality of quick release connectors comprise:

a plurality of T-shaped quick release connectors each having three tube connections thereon; and a plurality of Y-shaped quick release connectors each having three tube connections thereon;

wherein each of the T-shaped quick release connectors and the Y-shaped quick release connectors receives a number of the plurality of tubes therein.

4. The hydration pack of claim 3 wherein the first tube extends between a first Y-shaped quick release connector of the plurality of Y-shaped quick release connectors and a first T-shaped quick release connector of the plurality of T-shaped quick release connectors to form a loop that functions as one of the pair of shoulder straps; and wherein the second tube extends between the first Y-shaped quick release connector of the plurality of Y-shaped quick release connectors and a second Y-shaped quick release connector of the plurality of Y-shaped quick release connectors to form a loop that functions as another of the pair of shoulder straps.

5. The hydration pack of claim 3 wherein the plurality of additional tubes comprises a third tube and a fourth tube, wherein the third tube is connected to the first T-shaped quick release connector of the plurality of T-shaped quick release connectors and extends into a first collapsible water flask of the one or more collapsible water flasks, and wherein the fourth tube is connected to a second T-shaped quick release connector of the plurality of T-shaped quick release connectors and extends into a second collapsible water flask of the one or more collapsible water flasks.

6. The hydration pack of claim 5 further comprising a first screw-on cap coupled to the first collapsible water flask and a second screw-on cap coupled to the second collapsible water flask, wherein each of the first and second screw-on caps includes a hole formed therein through which the third tube and the fourth tube are fed, respectively, such that the third tube and the fourth tube may extend through the first and second screw-on caps and into the first and second collapsible water flasks.

7. The hydration pack of claim 1 wherein the plurality of tubes comprise BPA-free silver coated silicon tubes.

8. The hydration pack of claim 1 further comprising a pair of carabineer clips positionable about the first tube and the second tube to secure the first tube and the second tube on the hydration pack.

9. The hydration pack of claim 1 wherein the plurality of quick release connectors comprise push-to-connect fittings.

10. A hydration pack comprising:

one or more collapsible water flasks configured to carry fluid therein;

a plurality of tubes comprising:

a pair of tubes comprising a first drinking tube and a second drinking tube that form a pair of shoulder straps on the hydration pack and that support the weight of the one or more collapsible water flasks; and a plurality of additional tubes, with all of the pair of tubes and the plurality of additional tubes fluidly connected to the one or more collapsible water flasks to transport fluid out therefrom and provide fluid to the user; and a plurality of quick release connectors configured to receive the plurality of tubes therein and secure the plurality of tubes together, with the plurality of quick release connectors constructed to provide for a selective engagement and release of the plurality of tubes therefrom;

wherein the first tube and the second tube each comprise a loop formed by connection of the first tube and the second tube to respective quick release connectors of the plurality of quick release connectors, with the loops forming the pair of shoulder straps of the hydration pack.

* * * * *